United States Patent [19]

Bechgaard et al.

[11] 4,269,875

[45] May 26, 1981

[54] METHOD OF PRESERVING TIMBER

[75] Inventors: Carl C. Bechgaard, Vejle, Denmark; Joseph Dulat, Fetcham, England

[73] Assignee: Wood-Slimp GmbH, Chur, Switzerland

[21] Appl. No.: 89,722

[22] Filed: Oct. 31, 1979

Related U.S. Application Data

[63] Continuation of Ser. No. 899,884, Apr. 25, 1978, abandoned.

[51] Int. Cl.[3] ..... B05D 3/12; B27K 3/16

[52] U.S. Cl. ..... 427/291; 106/18.3; 252/397; 422/28

[58] Field of Search ..... 427/291, 4; 424/148; 252/397; 423/278; 106/18.3; 47/57.5

[56] References Cited

U.S. PATENT DOCUMENTS

| | | | |
|---|---|---|---|
| 2,062,081 | 11/1936 | Zwingauer | 427/291 |
| 2,970,404 | 2/1961 | Beaufils et al. | 47/57.5 |
| 4,076,871 | 2/1978 | Short et al. | 427/440 X |

FOREIGN PATENT DOCUMENTS

| | | | |
|---|---|---|---|
| 641714 | 5/1962 | Canada | 106/18.3 |
| 1365867 | 9/1974 | United Kingdom | 427/291 |

OTHER PUBLICATIONS

*The Merck Index,* 8th edition, 1968, p. 160.

*Primary Examiner*—Evan K. Lawrence
*Attorney, Agent, or Firm*—Cushman, Darby & Cushman

[57] ABSTRACT

A method of preserving timber from decay liable to arise in the presence of moisture, e.g. in railway sleepers, comprises forming cavities in the timber at appropriate points and inserting in each cavity a plug which has been fused into a monolithic element consisting of a water-soluble wood preservative such as boric oxide; the wood preservative diffuses into the timber from the plug, to establish a zone protected from decay, more slowly from a fused than from a compacted plug.

15 Claims, 3 Drawing Figures

METHOD OF PRESERVING TIMBER

CROSS REFERENCE TO RELATED APPLICATION

This is a continuation of our earlier application Ser. No. 899,884, filed Mar. 25, 1978.

BACKGROUND OF THE INVENTION

Structural timbers are liable to rot; the rot is caused by fungal infection which is more acute when the timber is wet. One familiar way of preserving timber is to impregnate it with a wood preservative and for this purpose there are used as preservative either creosote or various metal salts in solution.

Another method of preservation is to make a small hole in the timber at an appropriate position and put a solid wood preservative in the hole, so that it will slowly dissolve in water and then be transported to adjacent parts of the timber where it establishes a protected zone. The theory behind the use of inserted solids is that they form a reservoir, so that as the concentration of timber preservative in the 'protected zone' falls, by diffusion or leaching of the preservative, more preservative is released.

In the Swedish Journal "Järnvägs-Teknik" No. 1 of 1955 there is described a cartridge for insertion in a cavity formed in timber; this consists of a particulate wood-preservative salt bound together with a binder and contained in a fabric envelope.

It is an object of the present invention to provide a method of establishing a reservoir of wood preservative in timber, such that the time over which the preservative is dissipated into the surrounding zone to protect it from decay is prolonged.

It is a further object of the invention to provide a method of preserving timber in which there is used a novel, long-lasting, wood preservative element.

Another object of this invention is to provide a method of preserving timber in which there is used a source of boric acid more concentrated than boric acid itself.

SUMMARY OF THE INVENTION

In the method of the invention, a wood preservative element which is inserted in cavities in the timber to provide a reservoir which is slowly released into the timber, is in the form which consists of a fused body of wood preservative solid at ambient temperatures. The preferred wood preservative which makes up at least a major part of the fused body of this invention is boric oxide. Use of boric oxide as a wood preservative is, we believe, novel.

Boric oxide, $B_2O_3$, is itself a glass, i.e. a fused material, but is normally available as a powder, in the form of discrete particles. The element of the present invention is itself fused, that is, it is not composed of discrete particles of (fused) boric oxide or other preservative but is a single element.

We have found that whereas a compacted but unfused plug of boric oxide dissolves fairly rapidly in the moisture found in timber exposed to the weather, a fused plug dissolves more slowly, so gives protection over a longer period. The "life" of other particulate wood preservatives can similarly be prolonged by providing them as shaped, fused elements.

DESCRIPTION OF THE PREFERRED EMBODIMENTS

Figure 1:
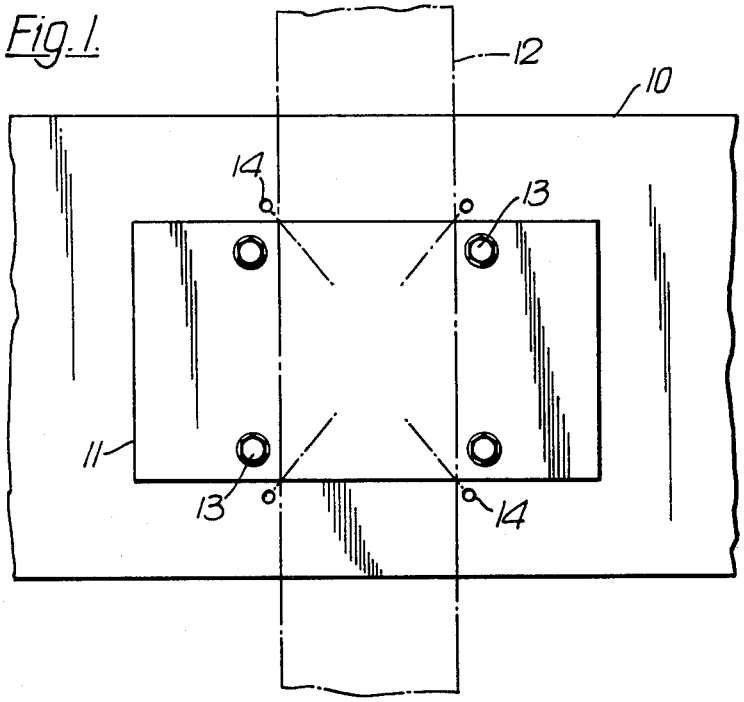
FIG. 1 is a plan view of part of a railway sleeper on which is mounted a base plate.

When the wood preservative in the fused body of this invention is boric oxide, it may contain other materials as well, and these may either be fused with the boric oxide or be present as discrete particles in a fused matrix of boric oxide. These will usually consist of minor proportions of metal oxides which effects one or both of the following:

(i) Control of the rate of solution in water.

(ii) Enhancement of the preservative power of the boric acid.

Typical examples of (i) are alkali metal oxides (which increase the rate of solution) and alkaline earth metal or silicon oxides (which reduce the rate of solution). Silica is especially valuable for retarding solution of boric oxide.

Typical examples of (ii) are copper oxide, tin oxide, zinc oxide; some fungi are controlled more effectively by copper oxide or one of the other metal oxides with boric acid.

The fused body used in the process of this invention may be a pre-shaped element, ready for insertion in a cavity formed in the timber.

Desirably it is then shaped as a plug, to fit a correspondingly shaped cavity in the timber. The most convenient form of plug is a rod or cylinder, e.g. a circular cylinder, having a length longer than its maximum width; alternative forms include blocks, tablets, pellets and bullets. These pre-shaped elements can be made by extruding the wood preservative in molten state or by moulding and compacting the particulate materials in a mould and then fusing it by heat to monolithic structure. Fusing of particulate material is preferred for boric oxide.

Thus one aspect of the invention is a method of preserving timber which comprises forming at least one cavity in the timber at or adjacent to a part of the timber most subject to decay; and inserting in each cavity a fused body according to the invention. The filled cavity can then be capped to prevent direct ingress of moisture. More than one such shaped body may be inserted, as exemplified below with respect to railway sleepers.

Advantageously there is formed a plurality of cavities in each of which is positioned at least one fused body. For example, in the case of a railway sleeper having a rectangular base plate, there may be two cavities on each side of the base plate, each directed downwardly through the sleeper and inwardly towards the centre of the base plate.

As a less preferred alternative to a pre-shaped plug, the body of this invention can be established in position in timber to be preserved, by drilling a cavity at the appropriate point in the timber and pouring or injecting molten boric oxide into the cavity.

If timber has been softened by decay, as is sometimes found in wooden boats and in other marine conditions, a shaped body according to the invention, especially a fused boric oxide plug, can be compact enough to be simply pushed into the wood.

Use of a fused body according to the invention has many advantages over use of other wood preservatives. Being fused, the plug is of high density, so that the volume occupied by a given weight of the wood preservative is less than for a particulate material. Consequently the cavity in which the plug is situated is smaller, so there is less mechanical weakening of the timber. It is also cheaper and quicker to drill a small hole than a large one. Moreover, the fused material dissolves more slowly in moisture in the timber than does the same material in particulate form, and yet can still dissolve fast enough to maintain the desired concentration of fungicide in the area of timber most subject to fungal attack.

Boric oxide dissolves in moisture of the timber to form boric acid which itself is the active ingredient. The boric acid diffuses into the bulk of the timber at a rate which is governed by the amount of free water available, i.e. the wetter the timber, the faster the movement of the preservative into it. One ml of fused boric oxide provides as much boric acid as 3 ml of boric acid.

The dissolution of a boric oxide plug can be retarded to give longer life to the plug, by the inclusion of silica. Thus under conditions where the life of a paste of boric acid could be expected to be five years, the life of a plug according to the invention could be expected to be 12–15 years.

Being smaller for a given weight of wood preservative the fused plugs require only small holes to accommodate them, thus causing less mechanical damage and weakening of the timber.

If a wood preservative more readily water soluble than boric oxide is present with boric oxide in the fused body of this invention it too will diffuse only slowly because it is embedded in the less soluble boric oxide.

In the preferred form of this invention, as described in the Example below, the preservative elements are homogeneous rods which are inserted in rod-shaped cavities previously drilled in the timber. The element may however, be a pellet or bullet or other shape, and may be forced into the timber.

After insertion of the preservative plugs into the timber they may be sealed therein with a cap of plastic or other suitable material. When the preservative has diffused through the timber the cavities can be simply replenished with fresh preservative by removing the cap and inserting further plugs.

The invention will now be illustrated, by way of example, by reference to the preservation of railway sleepers although the invention is equally applicable to other timber constructions discussed below.

Although the life of railway sleepers on a track which is only slightly used may be several decades, most sleepers require treatment with timber preservatives after about ten–fifteen years if they are to remain serviceable.

Decay in railway sleepers occurs initially around the track base plates, especially in the area adjacent to the screw holes where the base plates are secured to the sleeper.

A typical plug according to the invention for use in railway sleepers is a circular cylinder 80 mm long and 12 mm in diameter. This has a mass of about 16 g.

Cavities, usually eight in number arranged two to each side of each rectangular base plate, are drilled to a depth not more than half the depth of the sleeper. Each hole is just wide enough to receive a plug, and is inclined downwards towards a position beneath the central part of the base plate as illustrated in the accompanying drawings. The holes are drilled towards a position under the base plates in order that the timber preservative may be placed directly in the area most vulnerable to decay. Further, this area is the best protected with regard to the possible leaching out of water soluble preservatives if the sleepers are in areas prone to heavy rainfall. The area under the base plates also contains the most moisture, because of the condensation of water under the plate, the presence of which assists the diffusion of the timber preservative through the sleeper.

In the accompanying drawings, the sleeper is indicated as 10 and carries the base plate 11; the details of the base plate with its resilient attachment to the rail shown diagrammatically as 12 are not shown since it forms no part of this invention. The base plate is secured to the sleeper by four screws each referenced 13.

Figure 2:
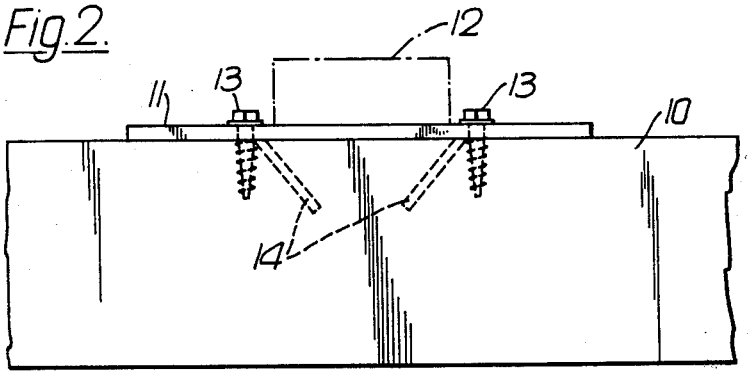
FIG. 2 is a front elevation of the sleeper.
Figure 3:
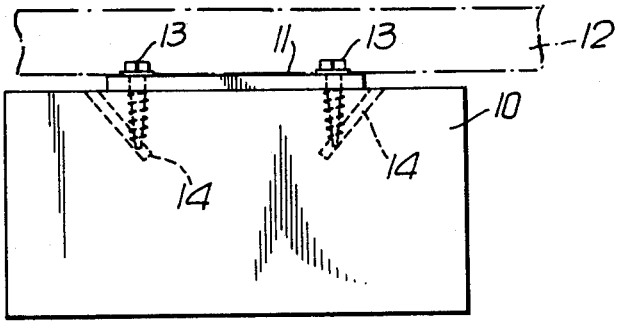
FIG. 3 is an end view of FIG. 1.

Cavities drilled to receive plugs according to the invention are referenced 14; the inclination of the cavities can be seen in FIGS. 2 and 3, and in FIG. 1 the direction of the cavities is indicated by chain line.

A plug according to the invention is then inserted in each hole, which can then be capped. If the holes are drilled of a length exceeding 150–200 mm, as may be necessary if they are inclined sharply from the vertical, two or three shorter rods may be used in each hole. Whereas a powdered insert or paste of wood preservative is liable to be squeezed out by pressure transmitted through the wooden sleeper by passing trains, the fused plug remains stable in position.

An interesting further advantage of fused bodies of this invention, at least when made solely from boric oxide or almost wholly from boric oxide, is that they do not increase the conductivity of the timber. This is in some cases important when the timber is incorporated in an automatic signalling system.

The size of a shaped body of this invention depends on the use for which it is intended. For railway sleepers, a cylindrical rod having a mass in the range 10 to 100 grams is suitable. For window frames and doors, a cylindrical rod having a mass in the range 1 to 10 grams is suitable, e.g. 18 mm long and 9 mm in diameter, with a mass of 2 to 2.5 grams.

The tops of wooden piles are subject to decay which may be arrested by inserting into a hole drilled in the pile or directly into decay-softened timber, a large fused pellet or rod, say 100 grams mass of wood preservative such as boric oxide.

In timber bridges, where it is important to limit the mechanical weakening caused by drilling holes rods of the same properties as recommended for railway sleepers may be used.

For the interior timbers of boats, fused balls of boric oxide each say 15 mm in diameter may be pushed into the timber. However, the mechanical strength and resistance to bending or snapping of a fused rod of boric oxide is sufficient to permit a rod 100 mm long, or even longer to be pushed into soft timber.

We claim:

1. A method of preserving timber from decay liable to be induced in the presence of moisture, which comprises forming at least one cavity in the timber and inserting in each such cavity one or more solid elements wherein each element consists of a water-soluble wood-preservative compound or composition which is solid at ambient temperatures and fused into a monolithic body shaped to substantially fit the cavity.

2. The method of claim 1, in which the wood preservative includes fused boric oxide.

3. The method of claim 2 in which the wood preservative consists solely of boric oxide.

4. The method of claim 2 in which the body comprises fused boric oxide as a matrix in which another material is incorporated.

5. The method of claim 4 in which said other material is a second wood preservative.

6. The method of claim 4 in which said other material includes an agent which modifies the rate of release of boric oxide from the body under conditions of use.

7. The method of claim 6 in which said agent is silica.

8. The method of claim 4 in which the body is in the form of a rod.

9. The method of claim 8 in which there are used rods each having a mass in the range 10 to 100 grams.

10. The method of claim 8 in which there are used rods each having a mass of 10 to 25 grams.

11. The method of claim 9, in which the rods are inserted in railway sleepers.

12. The method of claim 8 in which there are used rods each having a mass in the range 1 to 10 grams.

13. The method of claim 12 in which the rods are inserted in door frames or window frames.

14. The method of claim 8 in which there are used rods formed by compacting particulate boric oxide in a mould and fusing it into a monolithic body.

15. A method of preserving timber from decay liable to be induced in the presence of moisture, said method comprising:

(a) forming at least one cavity in the timber, and (b) inserting into each such cavity at least one said element consisting of a wood preservative compound or composition containing boric oxide, said element solid at ambient temperatures, fused into a monolithic body and shaped to fit a correspondingly shaped cavity in the timber.

* * * * *